US010561889B2

(12) United States Patent
Rossi et al.

(10) Patent No.: US 10,561,889 B2
(45) Date of Patent: Feb. 18, 2020

(54) PHYSICAL THERAPY SYSTEM

(71) Applicants: Dale Rossi, Vale, OR (US); Judith Rossi, Vale, OR (US)

(72) Inventors: Dale Rossi, Vale, OR (US); Judith Rossi, Vale, OR (US)

( * ) Notice: Subject to any disclaimer, the term of this patent is extended or adjusted under 35 U.S.C. 154(b) by 419 days.

(21) Appl. No.: 15/376,919

(22) Filed: Dec. 13, 2016

(65) Prior Publication Data

US 2018/0161619 A1 Jun. 14, 2018

(51) Int. Cl.
*A63B 21/00* (2006.01)
*A63B 21/04* (2006.01)
*A63B 21/055* (2006.01)

(52) U.S. Cl.
CPC ..... *A63B 21/4039* (2015.10); *A63B 21/0442* (2013.01); *A63B 21/0552* (2013.01); *A63B 21/4035* (2015.10)

(58) Field of Classification Search
CPC ..... A63B 21/02; A63B 21/04; A63B 21/0442; A63B 21/055–21/0557; A63B 21/1609; A47C 9/002
See application file for complete search history.

(56) References Cited

U.S. PATENT DOCUMENTS

| | | | | |
|---|---|---|---|---|
| 5,324,243 | A | 6/1994 | Wilkinson | |
| 6,500,104 | B1 | 12/2002 | Rich | |
| 7,850,585 | B1 | 12/2010 | Barboza | |
| 8,162,809 | B1 | 4/2012 | Eastwood | |
| 2008/0004166 | A1* | 1/2008 | Oren | A63B 21/0442 482/142 |
| 2009/0016336 | A1 | 1/2009 | LaVigne et al. | |
| 2015/0238800 | A1 | 8/2015 | Henry | |
| 2016/0263420 | A1* | 9/2016 | DuMee | A63B 21/0552 |

FOREIGN PATENT DOCUMENTS

WO WO2005107881 11/2005

* cited by examiner

*Primary Examiner* — Jennifer M Deichl

(57) ABSTRACT

A physical therapy system includes a chair has a seat and a backrest. An exercise unit is positioned on the chair and the exercise unit is selectively manipulated. The exercise unit includes a pair of resistance bands. Each of the resistance bands may be gripped. Each of the bands is selectively urged away from the chair thereby facilitating physical therapy.

5 Claims, 4 Drawing Sheets

PHYSICAL THERAPY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to therapy devices and more particularly pertains to a new therapy device for performing physical therapy while sitting in a chair.

BRIEF SUMMARY OF THE INVENTION

An embodiment of the disclosure meets the needs presented above by generally comprising a chair has a seat and a backrest. An exercise unit is positioned on the chair and the exercise unit is selectively manipulated. The exercise unit includes a pair of resistance bands. Each of the resistance bands may be gripped. Each of the bands is selectively urged away from the chair thereby facilitating physical therapy.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
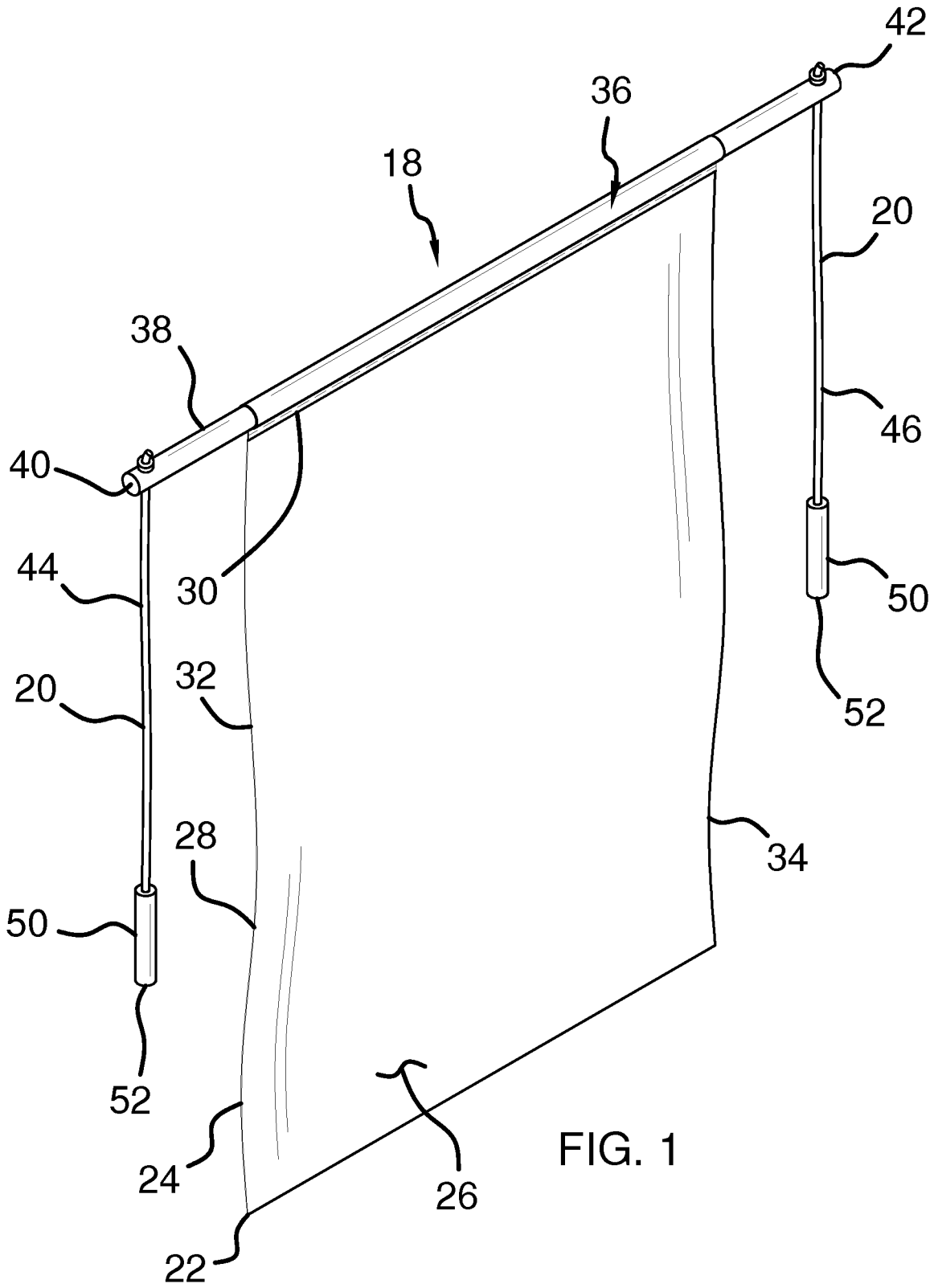
FIG. 1 is a perspective view of an exercise unit of physical therapy system according to an embodiment of the disclosure.
Figure 2:
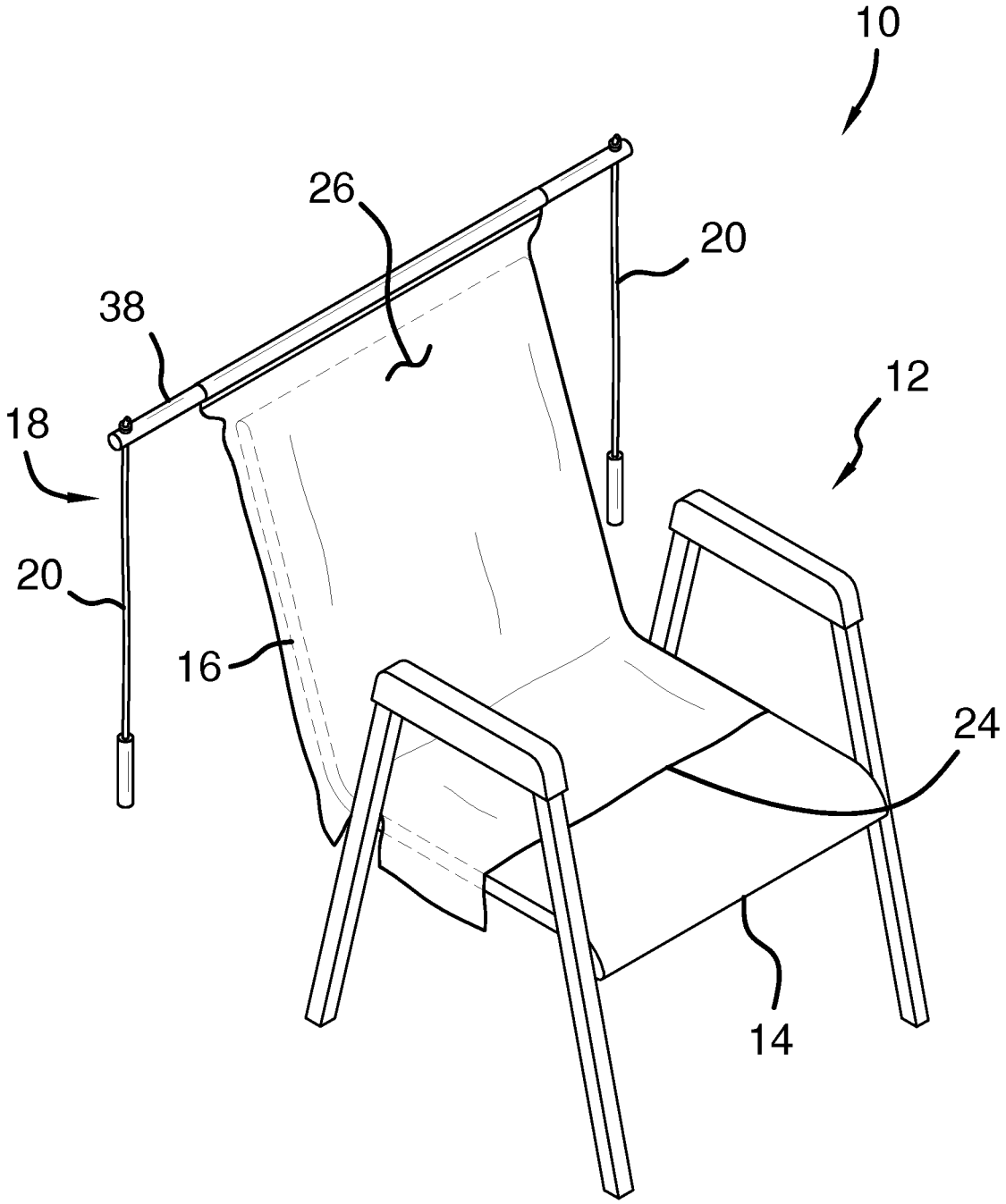
FIG. 2 is a front perspective view of an embodiment of the disclosure.
Figure 3:
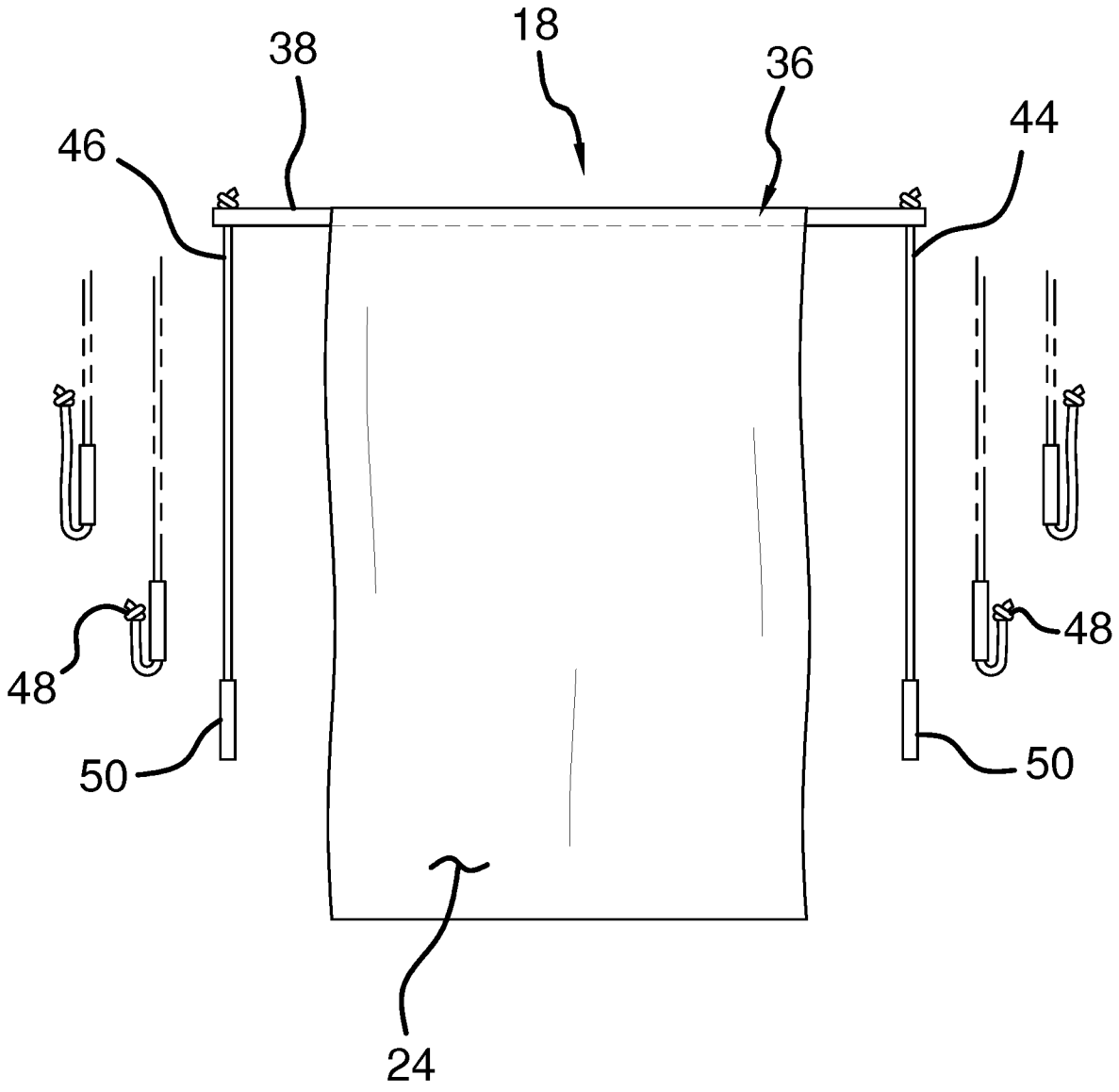
FIG. 3 is a back view of an exercise unit of an embodiment of the disclosure.

With reference now to the drawings, and in particular to FIGS. 1 through 4 thereof, a new therapy device embodying the principles and concepts of an embodiment of the disclosure and generally designated by the reference numeral 10 will be described.

As best illustrated in FIGS. 1 through 4, the physical therapy system 10 generally comprises a chair 12 that has a seat 14 and a backrest 16. An exercise unit 18 is provided. The exercise unit 18 positioned on the chair 12 and the exercise unit 18 may be manipulated. The exercise unit 18 includes a pair of resistance bands 20 and each of the resistance bands 20 may be gripped. Each of the resistance bands 20 is selectively urged away from the chair 12 thereby facilitating physical therapy to be performed.

The exercise unit 18 comprises a panel 22 and has first surface 24, a second surface 26 and a peripheral edge 28 extending therebetween. The peripheral edge 28 has a top side 30, a first lateral side 32 and a second lateral side 34. The first surface 24 is selectively positioned to cover the seat 14 and the backrest 16 and the second surface 26 is sat upon. Thus, the panel 22 is retained on the chair 12. The top side 30 of the panel 22 is coupled to the second surface 26 to define a channel 36 extending between the first lateral side 32 and the second lateral side 34. The panel 22 may be comprised of a deformable material such as a textile or the like.

A rod 38 is provided. The rod 38 has a first end 40 and a second end 42. Moreover, the rod 38 is positioned within the channel 36 and each of the first end 40 and the second end 42 is exposed. Each of the resistance bands 20 is coupled to the rod 38.

The pair of resistance bands 20 includes a first resistance band 44 and a second resistance band 46. The first resistance band 44 is aligned with the first end 40 of the rod 38. The second resistance band 46 is aligned with the second end 42 of the rod 38. Each of the resistance bands 20 has a distal end 48 with respect to the rod 38. Moreover, each of the resistance bands 20 is comprised of a resiliently stretchable material. Thus, each of the resistance bands 20 is configured to resist being stretched. Each of the resistance bands 20 may be stretched to rehabilitate a shoulder joint after surgery or the like.

A pair of handles 50 is provided and each of the handles 50 is slidably coupled to the distal end 48 of an associated one of the resistance bands 20. Moreover, each of the handles 50 may be gripped. Each of the handles 50 has a distal end 52 with respect to the resistance bands 20. The distal end 52 corresponding to each of the handles 50 is open. Each of the handles 50 is positioned at a selected point between the distal end 48 of the associated resistance band 20 and the rod 38. Thus, a resistance posed by each of the resistance bands 20 may be selectively increased.

Figure 4:
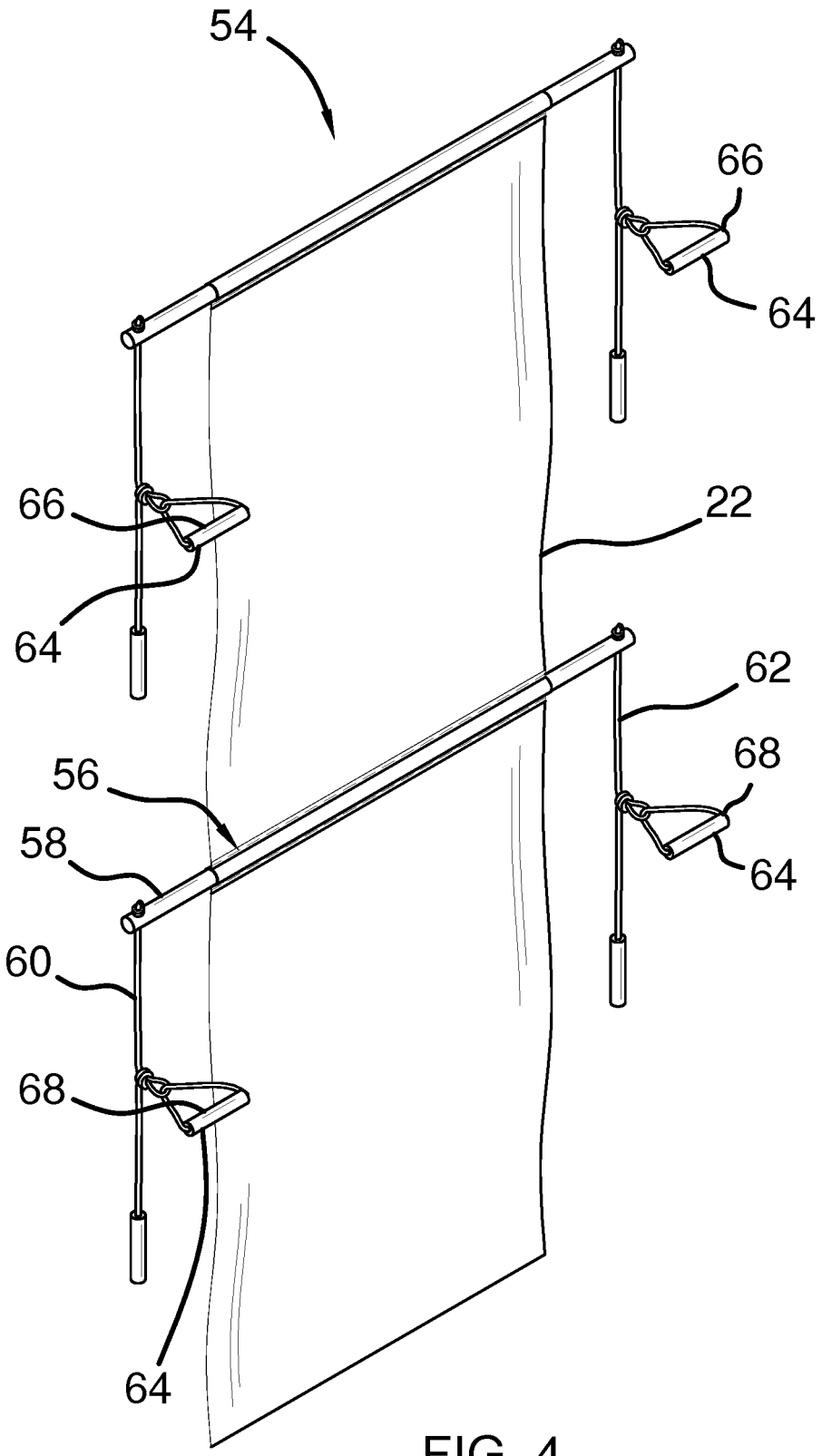
FIG. 4 is a perspective view of an alternative embodiment of the disclosure.

In an alternative embodiment 54 as shown in FIG. 4, the panel 22 may have a second channel 56 extending between the first lateral side 32 and the second lateral side 34. Moreover, the second channel 56 may be centrally positioned on the panel 22. A second rod 58 may be provided. The second rod 58 may be positioned within the second channel 56.

A third resistance band 60 and a fourth resistance band 62 may be provided. Each of the third 60 and fourth 62 resistance bands 20 may be coupled to the second rod 38. A set of grips 64 may be provided. A first pair of the grips 66 may each be coupled to an associated one of the first 44 and second 46 resistance bands. Moreover, each of the first pair of grips 66 may be positioned between the handles 50 and the first rod 38. A second pair of the grips 68 may each be coupled to an associated one of the third 60 and fourth 62 resistance bands 20. Each of the first 66 and second 68 grips may be selectively manipulated to accomplish physical therapy.

In use, the panel 22 is positioned on the chair 12 such that the rod 38 is positioned on a top edge of the backrest 16. The chair 12 is sat in and each of the handles 50 is gripped. Each of the handles 50 is selectively urged away from the chair 12 in a selected direction. Thus, each of the resistance bands 20 is stretched to facilitate physical therapy.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A physical therapy system comprising:

a chair having a seat and a backrest; and an exercise unit being positioned on said chair wherein said exercise unit is configured to be manipulated, said exercise unit including a pair of resistance bands, each of said resistance bands being configured to be gripped, each of said bands being configured to be selectively urged away from said chair thereby facilitating physical therapy, said exercise unit comprising a panel having a first surface, a second surface and a peripheral edge extending therebetween, said peripheral edge having a top side, a first lateral side and a second lateral side, said first surface being selectively positioned to cover said seat and said backrest wherein said second surface is configured to be sat upon, said top side being coupled to said second surface to define a channel extending between said first lateral side and said second lateral side, and a rod having a first end and a second end, said rod being positioned within said channel having each of said first end and said second end being exposed and extended laterally spaced from said backrest of said chair.

2. The system according to claim 1, further comprising each of said resistance bands being coupled to said rod.

3. The system according to claim 2, wherein said pair of resistance bands includes a first band and a second band, said first band being aligned with said first end of said rod, said second band being aligned with said second end of said rod, each of said resistance bands having a distal end with respect to said rod, each of said resistance bands being comprised of a resiliently stretchable material wherein each of said resistance bands is configured to resist being stretched.

4. The system according to claim 3, further comprising a pair of handles, each of said handles being coupled to said distal end of an associated one of said resistance bands wherein each of said handles is configured to be gripped.

5. A physical therapy system comprising:

a chair having a seat and a backrest; and an exercise unit being positioned on said chair wherein said exercise unit is configured to be manipulated, said exercise unit including a pair of resistance bands, each of said resistance bands being configured to be gripped, each of said bands being configured to be selectively urged away from said chair thereby facilitating physical therapy, said exercise unit comprising:

a panel having a first surface, a second surface and a peripheral edge extending therebetween, said peripheral edge having a top side, a first lateral side and a second lateral side, said first surface being selectively positioned to cover said seat and said backrest wherein said second surface is configured to be sat upon, said top edge being coupled to said second surface to define a channel extending between said first lateral side and said second lateral side, a rod having a first end and a second end, said rod being positioned within said channel having each of said first end and said second end being exposed and extended laterally spaced from said backrest of said chair, each of said resistance bands being coupled to said rod, said pair of resistance bands including a first band and a second band, said first band being aligned with said first end of said rod, said second band being aligned with said second end of said rod, each of said resistance bands having a distal end with respect to said rod, each of said resistance bands being comprised of a resiliently stretchable material wherein each of said resistance bands is configured to resist being stretched, and a pair of handles, each of said handles being coupled to said distal end of an associated one of said resistance bands wherein each of said handles is configured to be gripped.

* * * * *